US005342459A

United States Patent [19]

Klemp et al.

[11] Patent Number: 5,342,459

[45] Date of Patent: Aug. 30, 1994

[54] ALUMINUM ALLOY EXTRUDED AND COLD WORKED PRODUCTS HAVING FINE GRAIN STRUCTURE AND THEIR MANUFACTURE

[75] Inventors: Thomas J. Klemp; David W. Hohman; Richard A. Schuster, all of Massena, N.Y.

[73] Assignee: Aluminum Company of America, Pittsburgh, Pa.

[21] Appl. No.: 32,927

[22] Filed: Mar. 18, 1993

[51] Int. Cl.[5] ..... C22F 1/04

[52] U.S. Cl. ..... 148/690; 148/550; 148/552; 148/692; 148/693; 148/697; 148/700; 148/417; 148/439

[58] Field of Search ..... 148/690, 692, 693, 697, 148/700, 439, 417, 550, 552

[56] References Cited

U.S. PATENT DOCUMENTS

| | | | |
|---|---|---|---|
| 2,614,053 | 10/1952 | Bobb et al. | 148/690 |
| 3,133,796 | 5/1964 | Craig, Jr. | 428/654 |
| 3,306,787 | 2/1967 | Dies | 148/439 |
| 3,418,177 | 12/1968 | Pryor | 148/689 |
| 3,563,815 | 2/1971 | Meier et al. | 148/692 |
| 3,594,133 | 7/1971 | Cote et al. | 428/687 |
| 3,645,804 | 2/1972 | Ponchel | 148/502 |
| 3,762,962 | 10/1973 | Nilsson | 148/690 |
| 3,879,194 | 4/1975 | Morris et al. | 420/535 |
| 3,935,007 | 1/1976 | Baba et al. | 420/535 |
| 3,945,861 | 3/1976 | Anderson et al. | 148/690 |
| 4,000,007 | 12/1976 | Develay et al. | 148/523 |
| 4,042,424 | 8/1977 | Nicoud | 148/690 |
| 4,082,578 | 4/1978 | Evancho et al. | 148/690 |
| 4,113,472 | 9/1978 | Fister, Jr. et al. | 420/535 |
| 4,256,488 | 3/1981 | Livak | 420/534 |
| 4,589,932 | 5/1986 | Park | 148/690 |

*Primary Examiner*—Richard O. Dean
*Assistant Examiner*—Robert R. Koehler
*Attorney, Agent, or Firm*—Carl R. Lippert

[57] ABSTRACT

An aluminum alloy containing about 0.5 to 1.3% magnesium, about 0.4 to 1.2% silicon, about 0.6 to 1.2% copper, about 0.1 to 1% manganese, the balance substantially being aluminum along with impurities and incidental elements, is made into wrought wire, rod, bar or tube products by extrusion and cold working, preferably drawing, operations. The method includes extrusion within about 300° or 400° up to about 650° or 700° F. and even possibly up to 750° or 800° F. on a less preferred basis. Following extrusion, the product may be cold drawn either before or after, or both before and after, solution heat treatment and quenching. Rapid quenching is preferred. The product can then be artificially aged, for instance by heating to 375° F. The resulting product has a fine grain size and consistent and good properties so as to be useful in a number of applications.

39 Claims, No Drawings

ALUMINUM ALLOY EXTRUDED AND COLD WORKED PRODUCTS HAVING FINE GRAIN STRUCTURE AND THEIR MANUFACTURE

This invention concerns a method for producing improved aluminum alloy elongate products such as wire, rod, and bar made by operations including extrusion, specifically improved products of an aluminum, magnesium, silicon alloy also containing copper and manganese.

BACKGROUND OF THE INVENTION

Aluminum alloys have been widely used in structural, architectural, and aesthetic applications varying from sophisticated aerospace structures to architectural and furniture applications and even sports applications. Extrusions are a common form of aluminum alloy product as are rod products produced by extrusion with or without subsequent hot rolling and then some cold finishing such as cold drawing. Such rod shapes are generally round but other shapes can be used and find wide application in a number of industries.

A popular family of aluminum alloys is designated as 6XXX alloys in accordance with the Aluminum Association designation system wherein the 6XXX alloys refer to aluminum alloys containing magnesium and silicon as their major alloying additions. It is common in these alloys to include other elements such as chromium or manganese or copper or combinations of these and other elements. One very good example of 6XXX alloys is alloy 6013 which is described in U.S. Pat. No. 4,589,932, the entire contents of which are fully incorporated herein by reference. The Aluminum Association limits for alloy 6013 are 0.6 to 1% silicon, 0.8 to 1.2% magnesium, 0.6 to 1.1% copper, 0.2 to 0.8% manganese, 0.5% maximum iron, 0.1% maximum chromium, 0.25% maximum zinc, 0.1% maximum titanium, other elements 0.05 each, 0.15% total, the balance substantially aluminum. This alloy has performed very well in a number of applications, but it has been found that in certain production processes such as extruded and cold finished rod, large recrystallized grain sizes can occur in the final product which detract from strength properties by lowering them and making them inconsistent from extrusion to extrusion and even along the length of a given extrusion whereby different strength properties may prevail between the front, middle, and back sections of a product. Also, after anodizing or even etching such a product, the large grain pattern results in an undesirable appearance which detracts from product acceptance. If the extrusion stock (billets or castings used for extruding into extrusions) is relatively small, such as 6 to 8 or 9 inches diameter, or the resulting extrusion is quite thin, such as ⅛ or ¼ inch (or both), such can favor achieving finer grains than using larger commercial scale practices such as ingot or extrusion stock over 11 or 12 inches, such as 13-inch or 14-inch or 15-inch to 18 or 20 or 22-inch or larger diameter stock, and making extruded sections thicker than ¼ or ½ inch (for instance, above 1 or 1¼ inches thick) where, it has been found, the extrusion operation can lead to excessively large recrystallized grains later in the overall manufacturing process. In referring herein to thickness, such as thickness of an extrusion or extruded and drawn product, such refers to the smallest cross section dimension. For a round cross section, it is the diameter; for a rectangle, it is the smaller side.

In making cold finished wire, rod, and bar, a manufacturing method includes preheating or homogenizing an ingot or billet of the alloy which is followed by extrusion at elevated temperature. Extrusion can be followed by hot rolling to further reduce the size of the extruded section. For instance, a 6x6 extrusion can be hot rolled into a ¾inch round section. After this, the greatly elongated product is solution heat treated and quenched. A drawing or other cold working operation may precede the solution heat treatment, if desired, for instance as part of an overall size reduction schedule. Solution heat treatment for this alloy typically involves very high temperatures, such as temperatures above 1000° F. and typically results in a recrystallized grain condition which is undesirable if the grains are excessive in size which unfortunately is often the case. Following quenching, a cold finishing operation is employed such as by cold drawing to a reduction in size of typically about 10 or 20% after which the product is artificially aged to strengthen it.

In accordance with the invention, it has been found that controlling the extrusion temperature can actually overcome the problem of excessive grain sizes after solution heat treating. That is, extrusion temperatures of 850° or 1000° F. (as referred to in U.S. Pat. No. 4,589,932) can be detrimental in making certain cold finished rod, wire and bar, whereas extruding at temperatures of 400° to 600° F. can be quite beneficial in producing certain products of fine recrystallized grain size.

DETAILED DESCRIPTION

In accordance with the improved process, the alloy contains about 0.5 to 1.3% magnesium, preferably about 0.7 or 0.8 to 1.1 or 1.2% magnesium, and about 0.4 to 1.2%, preferably about 0.6 to 0.9 or 1%, silicon and about 0.6 to 1.2%, preferably about 0.7 to 1%, copper and about 0.1 to 1%, preferably about 0.2 or 0.3 to 0.7 or 0.8%, manganese with iron preferably around 0.5% or less, for instance 0.35 or 0.4% or less, the balance substantially aluminum and incidental elements and impurities. All composition percentages set forth herein are by weight. The alloy is solidified into working stock such as a 14 or 15-inch to 22-inch or larger diameter size by continuous casting or semi-continuous casting into a shape suitable for extrusion which is typically a round ingot.

The ingot may be machined or scalped to remove surface imperfections if desired or extruded without machining if the surface is suitable into a reduced sized shape. Before extrusion, the metal is preferably preheated or homogenized preferably at a temperature above 950° F., for instance within 1000° to 1050° or 1060° F. for over one hour, typically three or four hours or more, for instance, six or eight hours or more, preferably in a protective atmosphere.

Indirect extrusion can be preferred in this process where making rod, bar or wire, although direct extrusion may also be used on a less preferred basis. The extrusion ratio is desirably at least 5 to 1, for instance about 5 to 30:1, typically from 8 to 20:1 by which is meant that the extruded cross-sectional area is about from ⅛ to about 1/20 the cross-sectional area of the material before extrusion with extrusion ratios of about 12 to 18:1 being preferred. In practicing the invention, it is important that the extrusion temperature be within about 300° or 400° F. up to about 600° or 650° or 675° F., preferably above 400° F. and more preferably within about 500° or 550° F. or 650° F. Temperatures up to 700° or 750° F. or even 800° F. can be used but on a less preferred basis. Temperatures can be controlled by heating the extrusion stock and preferably also the extrusion chamber to the desired temperature. In accordance with the invention, it has been found that using extrusion temperatures as just described overcomes a tendency to encounter excessive grain size when the material recrystallizes during subsequent heating such as solution heat treating. Extrusions made by indirect extrusion often can have larger grains in the immediate outer surface or "skin" region, and in referring to grain size herein, such is intended to refer to the regions inside said skin region in indirect extruded extrusions or products made from such.

After extrusion, the extrusion may be hot rolled as an optional procedure to further reduce its size. For instance, if the desired product is less than ¾ inch across (for instance, if it is round and it is less than ¾ inch in diameter), that could be produced by hot rolling an extrusion approximately 6×6 inches square which, in turn, was produced from a round billet of approximately 25 inches in diameter. The hot rolling proceeds at temperatures of about 600° or 650° F. or 700° F. up to about 800° or 850°or even 900° F. and reduces the cross-sectional area of the extrusion by any desired amount which can be over 80% and even over 90% and even over 95% or more in the cross-section reduction.

After extrusion, or extruding and hot rolling if hot rolling is employed, the product optionally may be cold worked such as by drawing to a reduction in cross section up to 80%, typically 10 to 50%, for instance 18% or more, which can be in each of two or more drawing passes, or other forming or shaping operations, or both drawing and subsequent forming or shaping operations. Then the metal is solution heat treated, preferably in a protective atmosphere, and quenched. The solution heat treatment employs temperatures of over 950° F. and preferably about 1000° F. or more and more preferably 1020° or 1025° F. more. Temperatures of 1040 or 1050° F. or even higher such as temperatures up to 1060° or 1070° F. 10[ F. or more are desirable in solution heat treating this alloy although substantial melting related damage should be avoided. This is followed by quenching such as in cold water which can be accomplished by immersing the hot metal in the cold water or spraying cold water over the hot metal. Forced air quenching can be employed but on a somewhat less preferred basis but may have some application for very small cross sections. Next, the product is cold finished by which is meant it is further reduced in cross section by cold working, typically by cold drawing, although cold rolling or other procedures could also be employed. The working or drawing is referred to as cold by which is meant typically at room temperature although the metal can heat up some during the drawing or working operation. Preferably, the cold finishing is done by cold drawing with the preferred amount of cold drawing, varying somewhat with the size of the cold drawn product. For instance, for large sizes, such as sizes above 3 inches across, preferred cold reductions are from about 5 or 6 or 8% up to about 12 or 15% in area. For sizes smaller than 3 inches but larger than ¾ or 1 inch, it is preferred that the cold reduction exceed 15 or 18 or 20% or 25%, for instance, a cold reduction of 22% in area or a little more is useful. When the cross section of the cold finished product is 1 inch or ¾ inch or less, it is preferred that the cold reduction be 20% or more, for instance, 23 or 25% or even as high as 28 or 30% or 35% or more.

The cold drawn or cold finished product is then subjected to artificial aging wherein the product is heated over 250° or 270° F., for instance over 300° F., typically within about 330° or 340° or 350° F. to about 425° or about 435° F., preferably about 360° to 390° or 400° F. for a period of time within around 2 to 10 or 15 hours, typically about 3 or 4 hours to 5 or 6 hours for temperatures of about 350° to 390° F., the time generally varying inversely with temperature (higher temperature for a less time or a lower temperature for a longer time) typically to develop an artificially aged or T8 strength condition (the T8 designation of the Aluminum Association indicating a cold work procedure prior to artificial aging).

The product produced as just described will undergo recrystallization as something of a side effect during the solution heat treating phase, and when the above set forth production operations are conducted as described, it has been found that the final product will have a recrystallized grain size which features small grains. Typical transverse grain sizes range from ASTM-2 or 3 to ASTM-7 or 8 (higher numbers are finer grains) referring to ASTM E 112, the entire content of which is hereby incorporated by reference. Extrusions of the herein referred to alloy made identically to the invention process except for extrusion temperatures around 850° or 900° F. can have quite large transverse grain sizes such as ASTM-0.

EXAMPLE

Several ingots of alloy 6013 were cast having the following composition ranges, by weight: Si—about 0.71 to about 0.77%; Mg—about 0.92 to about 0.95%; Cu—about 0.85 to about 0.97%; Mn—about 0.33 to about 0.35%; Fe—about 0.13 to about 0.17%; Cr—about 0.01%; Ni—about 0.004%; Zn—about 0.02%; Ti—about 0.02 or 0.03%, the balance substantially aluminum and quite small amounts of B, Be and Na, along possibly with other impurities that weren't checked in analysis. These alloys were cast into round ingots about 15 inches in diameter and then homogenized by heating to a target temperature of about 1045° F. for about 8 hours, after which the ingots were cooled to room temperature and reheated to extrusion temperature and scalped hot. The ingots were extruded at temperatures generally ranging from about 543° F. to a little over 660° F. into the sizes indicated below in this example. The elongate products so made were then solution heat treated at about 1050° F. for times ranging from an hour to an hour and a half and then cold water quenched. After quenching, the extrusions were further reduced in cross section by drawing as follows:

| | | | | |
|---|---|---|---|---|
| Extruded | 1.385" | 2.25" | 3.210" | 3.5" |
| Drawn size | 1.25" | 2" | 2.875" | 3.25" |

In general, the cross-sectional reductions were within around 8% to a little over 20%, the larger the cross-sectional area, the less the reduction by cold drawing. After the cold drawing, the products were artificially aged at about 375° F. for about 4 hours. Tests for mechanical properties were run on the resulting products and the results indicated a good degree of consistency even from one size to another and a quite good degree of consistency within a given size of product. For instance, for the 1.25 round section, the ultimate strengths varied from about 64.5 to 64.9 ksi, and the yield strengths varied from about 63 to 63.9 ksi, and the elongations from about 10.5 to 12.3%. The compressive yield strengths varied from about 60.4 to about 61.3 ksi. For the 2-inch round, the ultimate strengths varied from about 64.4 to about 65.3 ksi; the yield strengths varied from about 62.6 to about 63.4 ksi; the elongations varied from about 9.7 to 11.1%; and the compressive yield strength varied from about 62.2 to about 62.7 ksi. For the 2.875-inch round, the ultimate tensile strength varied from about 62.9 to about 63.6; the tension yield strength varied from about 60.5 to about 61.8; the elongation varied from about 9.3 to 10.9%; and the compressive yield strength varied from about 61.7 to about 62 ksi. The above discussed strength properties indicated a good degree of consistency between extrusions and along the length of each extrusion, which is a further indicator of uniform fine grain size and uniform conditions along the length of the extrusion, which is an important consideration in extrusions. As can be seen, all the foregoing strength results are quite impressive and it is equally significant that there is not a wide variation among the various properties measured, particularly within a given size and even from size to size. Transverse ASTM grain size was 3 or finer.

As an indicator of machinability, machining tests were performed wherein the improved product indicated good machining results in terms of chip length and chip per unit weight.

In general, products produced in accordance with the invention have minimum strength levels as follows:

| Thickness | Tensile Str. (ksi) | Yield Str. (ksi) |
|---|---|---|
| up to 1 inch | 61 or 62 | 59 or 60 |
| over 1 inch to 4 inches | 60 | 56 to 58 |

When referring to a minimum (for instance for strength), such refers to a level at which specifications for materials can be written or a level at which a material can be guaranteed or a level that a user (subject to safety factor) can rely on in design. In some cases, it can have a statistical basis wherein 99% of the product conforms or is expected to conform with 95% confidence using standard statistical methods. As shown above, typical strength properties for invention extrusions are higher than the minimum levels just set forth.

By way of comparison with the foregoing example for practicing the invention, 15-inch round ingots of the following compositions were cast:

| | Si | Fe | Cu | Mn | Mg |
|---|---|---|---|---|---|
| A | .74 | .16 | .898 | .3 | .9 |
| B | .74 | .16 | .997 | .45 | .88 |

The ingots were homogenized as described above and then reheated to target or nominal extrusion temperatures of 800° F. and 900° F. and were extruded into rounds about 3¾inch diameter which were solution heat treated at about 1050° F., quenched and cold drawn into a 3.510 inch rod which was cold stretched to a 3.503 inch diameter rod. The rod was artificially aged at 375° for 4 hours. Tension strength measurements were made and the results were as follows:

| Composition | Target Extrusion Temp. | Ultimate Str. (ksi) | Yield Str. (ksi) | Elong. % |
|---|---|---|---|---|
| A | 800° F. | 52.9 | 52.5 | 18 |
| B | 800° F. | 54.1 | 52.7 | 15 |
| A | 900° F. | 55.1 | 53.6 | 16.5 |
| B | 900° F. | 54.4 | 53.4 | 13 |

These results are considered quite inferior to the results achieved in practicing the invention.

In referring to rod or wire or bar, generally wire is any shape less than about 0.375 inch across the smallest dimension. For sizes over 0.375 inch across, round shapes are often referred to as rod whereas other shapes, such as rectangles and triangles, are called bars. This is only mentioned in passing in order to emphasize that the products contemplated by the invention are not narrowly limited and include any wire, rod, bar or other product that is produced by operations including extrusion and subsequent cold finishing. The invention also encompasses the production of hollow extrusions as well as solid cross section extrusions. For hollow extrusions, the invention includes extruding, direct or indirect, at temperatures broadly within around 400° or 500° to 700° or possibly 800° F., preferably 600° or 620° to 650° F. at extrusion ratios within about 5 to 30 or more to one. If desired, the hollow extrusion can be annealed, for instance, for about 1½hours at about 650° F. The extrusion is then cold drawn, typically by pulling through a single die over a mandrel at a cross-sectional reduction of about 20% per pass which reduces the outside diameter and wall thickness. Two or three or more such passes can be used to accumulate a quite substantial cross-sectional area reduction of, for instance, 50 or 60% or more. Intermediate anneals can be used to ease the drawing operations. The drawn tube is solution heated as described above. The solution heating or intermediate annealing (:if used) in association with cold drawing involves temperatures that cause recrystallization and the invention facilitates achieving a fine recrystallized grain structure when recrystallization occurs. The solution heat treated and quenched tube can be further cold drawn, for instance to a reduction of around 20% in cross section, and then artificially aged as described above. The cold draw after solution heat treatment can increase the strength by 5 or 10% or possibly more.

The products in accordance with the invention can be segmented into shorter lengths that can be shaped or formed by working (which can include machining) into useful products such as hydraulic pistons (with or without anodizing), manifolds and cylinders. Hydraulic components are useful in various areas such as brake systems for vehicles such as automobiles, trucks (large and small) and trains. Another area includes lifts and hoists, stationary or mobile. Hydraulic cylinders can be made from hollow tubular products or solid cross sections (round or rectangular) made by the method of the invention and segmented. Hydraulic manifolds are similar to cylinders although they have more than one inlet or more than one outlet, or both, and movement of a piston (or valve) within the manifold establishes the direction or outlet (or inlet) to which (or from which) hydraulic fluid moves. The term "piston" as used herein embraces plugs (including valve plugs) that move, or are moved, within hydraulic power or control or other hydraulic or fluid cylinders or manifolds. The term "hydraulic component" as used herein encompasses all valves, pistons, plugs, cylinders, manifolds or other components used in contact with hydraulic fluid or otherwise in hydraulic systems.

Another application includes fasteners, such as rivets, nuts, screws and other fasteners, for aerospace or other fields. Nuts can be made by working a segmented rod and then machining it, or by machining alone. Rivets can be made by heading and segmenting wire and then heat treating as is known, it being significant that the improved wire can be made into rivets that can be driven and struck in the T6 (artificially aged) condition. The invention rivets have enough workability to be used even in the strong T6 temper produced by artificial aging after solution heat treatment.

Another application is vehicular suspension components such as tie rods, control rods or arms, struts and other components. For instance, a rod can be cold compressed at one end to provide an eye for fastening to another component and can have the other end threaded for attachment to another component. Strong, corrosion resistant, suspension components obviously offer advantage in automotive or other vehicular components.

It is to be appreciated that the invention products can be segmented into shorter lengths or used in longer lengths to make any number of useful products by cold or other working operations, by which is meant herein to include machining, cold striking or forging, bending, threading, swaging, segmenting elongate wire, rod, bar, tube or other stock, or any other shaping operation.

Unless indicated otherwise, the following definitions apply herein:

a. The term "ksi" is equivalent to kilopounds (1000 pounds) per square inch.

b. Percentages for a composition refer to % by weight.

c. The term "ingot-derived" means solidified from liquid metal by a known or subsequently developed casting process rather than through powder metallurgy techniques. This term shall include, but not be limited to, direct chill casting, electromagnetic casting, spray casting and any variations thereof.

d. In stating a numerical range or a minimum or a maximum for an element of a composition or a temperature or other process matter or a property or an extent of improvement or any other matter herein, and apart from and in addition to the customary rules for rounding off numbers, such is intended to specifically designate and disclose each number, including each fraction and/or decimal, (i) within and between the stated minimum and maximum for a range, or (ii) at and above a stated minimum, or (iii) at and below a stated maximum. (For example, a range of 1 to 10 discloses 1.1,1.2 . . . 1.9, 2, 2.1, 2.2 . . . and so on, up to 10, and a range of 500 to 1000 discloses 501,502 . . . and so on, up to 1000, including every number and fraction or decimal therewithin, and "up to 5" discloses 0.01 . . . 0.1 . . . 1 and so on up to 5.)

Having described the presently preferred embodiments, it is to be understood that the invention may be otherwise embodied within the scope of the appended claims.

What is claimed is:

1. The method of producing an improved elongate aluminum alloy product comprising:

providing an alloy consisting essentially of about 0.5 to 1.3% magnesium, about 0.4 to 1.2% silicon, about 0.65 to 1.2% copper, about 0. 1 to 1% manganese, the balance substantially aluminum and incidental elements and impurities;

extruding a body of said alloy within about 400° to about 750° F. at an extrusion ratio of at least 5 to 1;

solution heat treating at a temperature of at least about 990° F. and then quenching;

before or after or both before and after solution heat treating, cold working said alloy.

2. The method according to claim 1 wherein said extruding is within about 500° to 695° F.

3. The method according to claim 1 wherein said extruding is within about 550° to 650° F.

4. The method according to claim 1 wherein said extruding is within about 500° to 750° F. and the extrusion made by said extruding has a solid cross section and said alloy is cold worked by drawing after said solution heat treatment.

5. The method according to claim 1 wherein said extruding is within about 500° to 750° F. and the extrusion has a hollow cross section and said alloy is cold worked by drawing before said solution heat treatment.

6. The method according to claim 1 wherein said extruding is within about 500° to 750° F. and the extrusion has a hollow cross section and said alloy is cold worked by drawing after said solution heat treatment.

7. The method according to claim 1 wherein said extruding is within about 500° to 750° F. and the extrusion has a hollow cross section and said alloy is cold worked by drawing both before and after said solution heat treatment.

8. The method according to claim 1 wherein said extruding is within about 500° to 750° F. and the extrusion has a solid cross section and said alloy is cold worked by drawing before said solution heat treatment.

9. The method according to claim 1 wherein said extruding is within about 500° to 750° F. and the extrusion has a solid cross section and said alloy is cold worked by drawing both before and after said solution heat treatment.

10. The method according to claim 1 wherein said extruding is within about 500° to 750° F. and the extrusion made by said extruding has a solid cross section and said alloy is cold worked by drawing to a cross-sectional reduction of 6 to 15% after said solution heat treatment and the product so produced includes a thickness of 3 inches or more.

11. The method according to claim 1 wherein said extruding is within about 500° to 750° F. and the extrusion made by said extruding has a solid cross section and said alloy is cold worked by drawing to a cross-sectional reduction of 20 to 35% after said solution heat treatment and the product so produced includes a thickness of less than 1 inch.

12. The method according to claim 1 wherein said extruding is within about 500° to 750° F. and the extrusion made by said extruding has a solid cross section and said alloy is cold worked by drawing to a cross-sectional reduction of 15 to 25% after said solution heat treatment and the product so produced includes a thickness within about 1 to 3 inches.

13. The method according to claim 1 wherein said extruding is within about 500° to 750° F. and the extrusion has a hollow cross section and said alloy is cold worked by drawing to produce a cross-sectional reduction of at least 40% in two or more drawing passes before said solution heat treatment.

14. The method according to claim 1 wherein said extruding is within about 500° to 750° F. and the extrusion has a hollow cross section and said alloy is cold worked by drawing to produce a cross-sectional reduction of at least 18% in each of two or more drawing passes before said solution heat treatment.

15. The method according to claim 1 wherein said extruding is within about 500° to 750° F. and the extrusion has a hollow cross section and said alloy is cold worked by drawing to produce a cross-sectional reduction of at least 18% after said solution heat treatment.

16. The method according to claim 1 wherein said body of said alloy has a diameter over 11 inches.

17. The method according to claim 1 wherein said body of said alloy has a diameter over 12 inches.

18. The method according to claim 1 wherein the extruding produces an extrusion having a thickness greater than about ¾ inch.

19. The method according to claim 1 wherein the extruding produces an extrusion having a thickness greater than about 1 inch.

20. The method according to claim 1 wherein the extruding produces an extrusion having a thickness greater than about 1¼ inch.

21. The method of producing an improved elongate aluminum alloy product comprising:

providing an alloy consisting essentially of about 0.5 to 1.3% magnesium, about 0.4 to 1.2% silicon, about 0.65 to 1.2% copper, about 0.1 to 1% manganese, the balance substantially aluminum and incidental elements and impurities;

heating said alloy at a temperature of over 1000° F. for more than an hour;

extruding said alloy within about 450° to about 650° F. at an extrusion ratio of about 5 to 30;

solution heat treating said alloy within about 1020° to 1080° F. and quenching said metal;

cold drawing said alloy to a reduction in cross section of over 5%;

artificially aging said alloy above 300° F.

22. The method of producing an improved elongate aluminum alloy product comprising:

providing an alloy consisting essentially of about 0.5 to 1.3% magnesium, about 0.4 to 1.2% silicon, about 0.6 to 1.2% copper, about 0.1 to 1% manganese, the balance substantially aluminum and incidental elements and impurities;

homogenizing said alloy;

extruding said alloy within about 450° to about 650° F. at an extrusion ratio of about 5 to 30;

hot rolling within about 600° to 900° F.; solution heat treating said alloy within about 1020° to 1080° F. and quenching said metal;

cold drawing said alloy to a reduction in cross section of over 5%; artificially aging said alloy above 300° F.

23. A product whose production includes the method of claim 1.

24. A product whose production includes the method of claim 2.

25. A product whose production includes the method of claim 3.

26. A product whose production includes the method of claim 4.

27. A product whose production includes the method of claim 5.

28. A product whose production includes the method of claim 6.

29. A product whose production includes the method of claim 7.

30. A product whose production includes the method of claim 8.

31. A product whose production includes the method of claim 9.

32. A product whose production includes the method of claim 10.

33. A product whose production includes the method of claim 11.

34. A product whose production includes the method of claim 12.

35. A product whose production includes the method of claim 13.

36. A product whose production includes the method of claim 14.

37. In the method of producing a hydraulic component wherein elongate aluminum alloy stock is shaped by one or more working operations into said component, the improvement wherein the production of said elongate stock includes the method of claim 1.

38. In the method of producing an aluminum alloy fastener or fastener component wherein elongate aluminum alloy stock is shaped by one or more working operations into said fastener or component, the improvement wherein the production of said elongate stock includes the method of claim 1.

39. In the production of a vehicular suspension component wherein elongate aluminum alloy stock is shaped by one or more working operations into said suspension component, the improvement wherein the production of said elongate stock includes the method of claim 1.

* * * * *

UNITED STATES PATENT AND TRADEMARK OFFICE

CERTIFICATE OF CORRECTION

PATENT NO. : 5,342,459

DATED : August 30, 1994

INVENTOR(S) : Thomas J. Klemp; David W. Hohman; Richard A. Schuster

It is certified that error appears in the above-identified patent and that said Letters Patent is hereby corrected as shown below: On the title page: Item [56]

| | |
|---|---|
| Under "References Cited", under the subheading "Other Documents" | Add the following publication: --"A New Alloy for Use in Body Parts for Motor Vehicles", by M. Buratti et al, Alluminio, Vol. 47, No. 10, pp. 372-374.-- |
| Col. 2, line 68 | After "500 or 550", add --to 600°F-- |
| Col. 3, line 42 | After "1070°F", delete "10[F." and substitute --1080°F-- |
| Col. 4, line 56 | After "Extruded", insert --size-- |

Signed and Sealed this

Fourth Day of April, 1995

Bruce Lehman

*Attest:*

BRUCE LEHMAN

*Attesting Officer*

*Commissioner of Patents and Trademarks*